US008393128B2

(12) United States Patent
Klersy

(10) Patent No.: US 8,393,128 B2
(45) Date of Patent: Mar. 12, 2013

(54) PROCESS OF COMBINING TWO MODULAR UNITS WITH ONE ANOTHER, AND A THUS COMBINED HOUSE BODY

(76) Inventor: Hans-Berth Klersy, Wiesbaden (DE)

( * ) Notice: Subject to any disclaimer, the term of this patent is extended or adjusted under 35 U.S.C. 154(b) by 588 days.

(21) Appl. No.: 12/451,340

(22) PCT Filed: May 7, 2008

(86) PCT No.: PCT/IB2008/001120

§ 371 (c)(1),
(2), (4) Date: Feb. 22, 2010

(87) PCT Pub. No.: WO2008/135849

PCT Pub. Date: Nov. 13, 2008

(65) Prior Publication Data

US 2010/0146872 A1 Jun. 17, 2010

(30) Foreign Application Priority Data

May 8, 2007 (SE) ..... 0701130

(51) Int. Cl.
*E04B 1/348* (2006.01)
*E04B 1/38* (2006.01)
*E04B 1/04* (2006.01)

(52) U.S. Cl. ..... 52/745.21; 52/742.14; 52/747.12; 52/79.11; 52/259; 52/431; 52/436; 52/583.1

(58) Field of Classification Search ..... 52/79.11, 52/169.7, 169.14, 258, 259, 415, 431, 432, 52/437, 583.1, 742.14, 745.21, 747.12, 436, 52/742.15, 742.16
See application file for complete search history.

(56) References Cited

U.S. PATENT DOCUMENTS 3,510,997 A * 5/1970 Ratych ..... 52/79.2
3,848,377 A * 11/1974 Mori ..... 52/169.1
(Continued)

FOREIGN PATENT DOCUMENTS

DE 36 34 568 A1 * 7/1987
FR 2 649 149 * 1/1991
JP 6-73746 * 3/1994

OTHER PUBLICATIONS

International Search Report for PCT/IB2008/001120, mailed Jul. 15, 2008.

(Continued)

*Primary Examiner* — Robert Canfield
(74) *Attorney, Agent, or Firm* — Nixon & Vanderhye PC

(57) ABSTRACT

The present invention encompasses a process for initially combining and thereafter uniting two or more modular units to one another in order thus combined to be able to form a house body, for instance a cellar-adapted house body. A liquid-resistant layer is advantageously wholly or partly to be able to cover a base slab and in any event lower wall sections allocated to the wall portion, proximal the base slab, in order principally to prevent damp permeation. A first modular unit, with in any event a first open wall portion, is placed on a substrate prepared within a building site, a second modular unit, with in any event a second open wall portion, is placed on the substrate prepared within the building site, so that an open wall portion allocated to the first modular unit will connect to an open wall portion allocated to the second modular unit. The base slab of the one modular unit and the base slab of the second module form a free space defined by the mutually facing edges of the base slabs. The base slab of the one modular unit is connected, with the aid of a tractive force absorbing reinforcement, to the base slab of the second module over the free space and that the free space is filled with concrete or the like. The present invention also encompasses a house body thud produced.

20 Claims, 3 Drawing Sheets

U.S. PATENT DOCUMENTS

| | | | | |
|---|---|---|---|---|
| 4,010,579 | A | 3/1977 | Galvagni | |
| 4,432,176 | A * | 2/1984 | Balzer | 52/293.1 |
| 5,216,860 | A | 6/1993 | Thomson et al. | |
| 5,761,862 | A * | 6/1998 | Hendershot et al. | 52/271 |
| 6,032,421 | A * | 3/2000 | Yamada | 52/79.8 |
| 6,122,887 | A * | 9/2000 | Massett et al. | 52/741.4 |
| 6,301,851 | B1 * | 10/2001 | Matsubara | 52/430 |
| 6,453,628 | B2 * | 9/2002 | Traxler | 52/169.14 |
| 7,426,808 | B2 * | 9/2008 | Sanger | 52/742.14 |
| 2009/0139177 | A1 * | 6/2009 | Holdsworth et al. | 52/713 |
| 2009/0308005 | A1 * | 12/2009 | Ireland et al. | 52/250 |

OTHER PUBLICATIONS

Written Opinion of the International Searching Authority for PCT/IB2008/001120, mailed Jul. 15, 2008.

International Preliminary Report on Patentability for PCT/IB2008/001120, completed Apr. 7, 2009.

* cited by examiner

PROCESS OF COMBINING TWO MODULAR UNITS WITH ONE ANOTHER, AND A THUS COMBINED HOUSE BODY

This application is the U.S. national phase of International Application No. PCT/IB2008/001120, filed 7 May 2008, which designated the U.S. and claims priority to Sweden Application No. 0701130-7, filed 8 May 2007, the entire contents of each of which are hereby incorporated by reference.

TECHNICAL FIELD

The present invention relates in general to a process of combining two house body related modular units with one another, so as to form a continuous building or house body.

The process disclosed, according to the present invention, is based on the insight of utilising modular units, produced as semi-manufactures, which are directly adapted to be able to be subject to industrial and efficient manufacture, with a greater or lesser degree of refinement and with different outer dimensions.

The degree of refinement should, as regards the present invention, be driven so far that two or more separate, alike or unlike, modular units are to be able to be coordinated with one another, so as to form a house body, and in particular a house body, with a base slab and edge-related coordinated wall portions.

While the present invention should not be seen as restricted exclusively to a square or rectangular base slab, with its four wall portions secured thereto or integrated therewith and oriented in relation to the edges, the following description will concentrate to this geometric configuration in order thereby to be able to simplify an understanding of and a presentation of the process associated with the present invention.

Thus, according to the principle process of the present invention, there are to be created the preconditions in order initially to unite and thereafter fixedly combine two or more modular units, structured as individual units, in the form of semi-manufactures to one another, in order to be able to form thus combined a house body such as a cellar-adapted house body with a base slab and wall portions related thereto in whole- or semi-manufacture.

Each one of these modular units, in the form of semi-manufactures, is then to consist of a base slab, a plurality, for instance two or more, of wall portions coordinated with the base slab and preferably a liquid-resistant layer, where said liquid resistant layer advantageously is to be able wholly or partly to cover the base slab and in any event those lower wall sections allocated to wall portions proximal the base slab, in order, principally and in a cellar embodiment, to prevent the permeation of damp.

Thus, the present invention offers a possibility of industrially manufacturing modular units in a semi-manufacture process, where the outer dimensions of the modular unit can be adapted to valid requirements for surface transport, for instance by road, rail and the like, or valid requirements for sea transport, between harbour installations, and where each one of these, or selected, modular units is to be able to be combined into a finished house body with dimensions greatly exceeding those dimensions which different transport possibilities can offer and in particular if it is a matter of cellar or basement modules, requiring a liquid-tight or liquid resistant layer, dimensioned so as to be able to withstand calculated geostatic pressure.

The present invention also encompasses individual modular units, particularly adapted to be put to use in a process disclosed according to the present invention and a house body constructed from a number of such modular units, duly united with one another.

The present invention has specific applications as regards combining in liquid-tight fashion base slabs to one another by creating a liquid-tight connection between a first base slab and a second base slab and in addition a liquid-tight connection between a first vertically oriented edge portion of a first wall section and a second vertically oriented edge portion coordinated therewith for a second wall portion and in addition create the preconditions for a liquid-tight connection between the connection of the base portions and the connections between the wall portions and the base slab.

The process associated with the present invention requires a seal between edge-to-edge oriented wall sections.

Even if it is known in this instance to be able to utilise different prior art means and processes, it is specially proposed, within the process related to the present invention, to make for the utilisation of a sealing system, a process and a formed seal, which are more closely described in the Swedish Patent Application, with allocated Application Number 07 000908 7 entitled "A method of forming a seal of a gap as well as an elastic hose portion adapted to be able to be utilised in such a method", filed by the same Applicant as the present application, and where said patent application is to be considered as a part of and be incorporated in this application and its description.

The wall portions utilised according to the present process may be of semi-manufacture or whole manufacture. In the first intimated embodiment with wall portions formed as semi-manufactures, these could be supplemented to whole manufactures via a process disclosed and described in the Swedish Patent Application, with allocated Application Number 07 01079 6 entitled "A method of forming a heavy modular unit and a thus produced modular unit" and filed by the same Applicant as the present application, and where it is a matter of taking as a point of departure an "empty" wall element, where the opposing outer wall surfaces are to be dimensioned to be able to withstand the inner forces, which act under a pouring process so as to form a stable casting mould or form, fill this mould or form with fibre reinforced concrete material in order, after setting, to form a "heavy" or complete wall element and where said patent application is to be considered as a part of and be incorporated in this application and its description.

BACKGROUND ART

Methods, arrangements and constructions relating to the above disclosed technical field and nature are previously known in the art in a plurality of different embodiments.

As a first example of the state of the art and the technical field to which the present invention relates mention might be made that it is previously known to industrially produce, as with a higher or lesser degree of refinement, semi-manufactures of different types of modular elements in order, in an assembled state, to form a part of or a complete house body.

It is also known in the art to industrially produce, as with more or less degree of refinement, semi-manufactures of cellar-adapted modular units which, in a unit or coordinated, are to be able to be supported by a prepared foundation slab or the like and where, when these modular elements are to be industrially provided with a liquid-resistant layer, an insulating plate, plastic or rubber slab, measures are to be implemented in order effectively to prevent damp permeation and/or a layer insulating against heat or cold, an insulating slab of known nature.

Thus the present invention builds on a process of initially combining and thereafter uniting two or more, alike or unlike, modular units to one another in order thus combined to be able to form a house body, such as a cellar-adapted house body.

Each one of these modular units, as semi-manufactures, are then preferably to consist of a base slab, a plurality, for instance two or more, of wall portions coordinated with the base slab, and a liquid-resistant layer, where said liquid-resistant layer advantageously wholly or partly is to be able to cover the base slab and in any event lower wall sections, allocated to the wall portion, proximal the base slab in order principally to prevent any type of damp permeation.

The present invention is specially intended to disclose properties, which will build on the method or the process defined in the preamble to appended claim 1.

The following Patent Publications are also forming a part of the prior art.

Thus publication U.S. Pat. No. 4,010,579-A discloses three dimensional pre-fabricated self-supporting elements, each being one-quarter of a portion of a room.

These elements are formed with a floor section, a ceiling section and at least two interposed wall sections.

These elements are integrally pre-formed with stiffening structural ribs or ribs shaped to provide support means for differently shaped pieces of furniture, with door and window apertures, with channel passages, pipe fittings and the like for receiving pipes and electrical wiring for utilities and inter engaging fitting means formed integrally on the outside of those floor, ceiling and wall sections to fasten together elements forming a room or an number of rooms together to form residences of one or more floors.

Especially FIG. 17 is illustrating a cross-section view of an embodiment of a turnbuckle fastening means, arranged between two adjacent elements The Patent Publication U.S. Pat. No. 5,216,860-A discloses a building system utilizing outwardly projecting legs on a horizontally or vertically extending purlin to connect with standard stirrups on conventional columns in a rebar assembly.

The stirrups are force-fit within the legs of the purlins extending outwardly from the surface of adjoining wall sections such that the rebar and the wall sections are connected in a uniframe construction without welding and a metal form can be fitted around the connection to form a channel, into which concrete may be poured to form a unitary structure.

BRIEF SUMMARY OF THE PRESENT INVENTION

Technical Problem

Taking into account the circumstance that the technical considerations which a person skilled in the art must do in order to be able to offer a solution of one or more set technical problems is on the one hand initially a necessary insight into the measures and/or the sequence of measures to be implemented and on the other hand a necessary selection of the means required, in view hereof the following technical problems are likely to be relevant in the evolution of the subject matter of the present invention.

Taking into account the state of the art, as described above, it is probably therefore likely to be seen as a technical problem to be able to realise the importance of, the advantages associated with and/or the technical measures and considerations which will be required in order, in a process, for initially combining and thereafter uniting two or more modular units to one another in order to be able thus combined to form a complete house body with three, four or more wall portions, such as a cellar-adapted house body, where each one of these modular units is to consist of a base slab, a plurality, for instance two or more, wall portions coordinated with the base slab and preferably a liquid-resistant layer, where a choice of said liquid-resistant layer advantageously will be able wholly or partly to cover the base slab and in any event lower wall sections, allocated to the wall portion proximal the base slab in order principally to be able to prevent damp permeation, with a simple operation to be able to facilitate work at a building site in order, with the aid of modular units serving as semi-manufactures, to be able to construct against a base slab or the like, a house body, such as a cellar house body, and where the degree of refinement of each utilised modular unit within the industrial production normally can be simply adapted to set requirements.

There resides a technical problem in being able to realise the importance of, the advantages associated with and/or the technical measures and considerations which will be required, in order, in accordance with the process according to the invention, to cause a first modular unit produced as a semi-manufacture with in any event one wholly or partly open wall portion to be positioned on a substrate prepared within a building site and to cause a second modular unit, produced as a semi-manufacture, with in any event one wholly or partly open wall portion to be placed on said substrate prepared within the building site, so that the open wall portion, allocated the first modular unit, will connect to the open wall portion, allocated to the second modular unit.

There resides a technical problem in being able to realise the importance of, the advantages associated with and/or the technical measures and considerations which will be required in order to cause the base slab of the one modular unit and the base slab of the second modular unit to form an interjacent free space, defined by the edge extents of the base slabs facing towards one another.

There resides a technical problem in being able to realise the importance of, the advantages associated with and/or the technical measures and considerations which will be required in order to cause the base slab of the one modular unit to be connected, with the aid of tractive force absorbing means, to the base slab of the second module over said free space and that the free space will thereafter be able to be filled with concrete or the like, ideally with a mixture of fresh concrete mass and a selected fibre material.

There resides a technical problem in being able to realise the importance of, the advantages associated with and/or the technical measures and considerations which will be required in order, in a cellar application, to cause a first part of the one modular unit to extend towards and/or over said free space along its allocated edge extent, facing towards the second modular unit, provided with the liquid-resistant layer, to cause a second part of the second modular unit to extend towards and/or over said free space, along its allocated edge extent, facing towards the first modular unit, allocated liquid-resistant layer, to be placed a strip or band of a liquid-resistant material.

There resides a technical problem in being able to realise the importance of, the advantages associated with and/or the technical measures and considerations which will be required in order to cause said strip or band to be dimensioned so as to wholly or partly cover said first part and said second part and that the band section is secured or sealed in liquid-resistant fashion against said first part and against said second part.

There resides a technical problem in being able to realise the importance of, the advantages associated with and/or the technical measures and considerations which will be required in order to cause the liquid-resistant layer, related to the first and the second modular unit, to be given such surface-adapted dimensions that each one of the layers will be able to extend under the base slab and upwards a selected distance along one or two wall sections and that said strip or band should be given a corresponding length.

There resides a technical problem in being able to realise the importance of, the advantages associated with and/or the technical measures and considerations which will be required in order to cause the fixing of insulating ground slabs to the outer surface extents of said liquid-resistant layer.

There resides a technical problem in being able to realise the importance of, the advantages associated with and/or the technical measures and considerations which will be required in order under said strip or band to apply a narrow ground slab corresponding to the width of the space, insulating against heat and cold, as an inlay between the ground slabs of each respective modular unit.

There resides a technical problem in being able to realise the importance of, the advantages associated with and/or the technical measures and considerations which will be required in order to cause the liquid-resistant plastic or rubber strip or band to be wholly welded to said first and second parts.

There resides a technical problem in being able to realise the importance of, the advantages associated with and/or the technical measures and considerations which will be required in order to be able to apply over said band within the formed gap between the first edge extent of the first base slab and the second edge extent of the second base slab a reinforcement principally absorbing tractive forces between the bottom portions of the modular units.

There resides a technical problem in being able to realise the importance of, the advantages associated with and/or the technical measures and considerations which will be required in order to cause said reinforcement to be formed from two or more elongate reinforcement iron rods acting at right angles to the expected tractive forces, extending through lugs in the mutually facing edge extents of the base slabs and formed holes in utilised connection plates.

There resides a technical problem in being able to realise the importance of, the advantages associated with and/or the technical measures and considerations which will be required in order to utilise as concrete material a concrete material reinforced with fibres, such as steel fibres.

Solution

In this instance, the present invention takes as its point of departure the prior art, as disclosed by way of introduction, and discloses a process for initially combining and thereafter fixedly uniting two or more modular units to one another in order to be able thus combined to form a house body, such as a cellar-adapted house body, where each one of these, in the form of semi-manufacture, modular units consists of a base slab.

The present invention specially discloses that a first modular unit, with in any event one open wall portion, is to be lowered down and placed on a substrate, prepared within a building site, that a second modular unit, with in any event one open wall portion, is placed on said substrate prepared within the building site, so that the open wall portion, allocated to the first modular unit will connect to the open wall portion, allocated to the second modular unit.

The present invention suggests that a plurality, such as two or more, of wall portions, are coordinated with the base slab, and that a liquid-resistant layer, is to wholly or partly cover the base slab and in any event lower wall sections allocated to the wall portion proximal the base slab, in order principally to prevent damp permeation.

The base slab of the one modular unit and the base slab of the second module is initially to be able to form a free space between them, where this space is defined by the mutually facing edge extents of the base slabs.

The base slab of the one modular unit is then to be connected in the edge surface, with the aid of tractive force absorbing means, to the base slab of the second module and its edge surface, over said free space and that the free space can thereafter be filled with concrete or the like, such as fresh concrete mass containing fibres.

As proposed embodiments, falling within the scope of the basic concept of the present invention, it is in addition disclosed that a first part of the one modular unit extends towards and/or over said free space, along its allocated edge extent, facing towards the second modular unit, provided with the liquid-resistant layer, that a second part of the second modular unit extends towards and/or over said free space, along the edge extent, facing towards the first modular unit, allocated the liquid-resistant layer, is placed a plastic or rubber strip or band of a liquid-resistant material.

It is further disclosed that said strip or band is to be dimensioned in order wholly or partly to be able to cover said first part and said second part and that strip or band sections are secured or sealed in liquid-resistant fashion against said first part and against said second part.

The liquid-resistant layer, related to the first and the second modular unit, is given such surface-adapted dimensions that each one of these two layers extends under the base slab and upwards a selected distance along one or two wall sections and that said strip or band is given a corresponding length and width.

Insulating ground plates or slabs are secured to the outer surface extent of said liquid-resistant layer.

Under said strip or band there is applied a narrow ground slab corresponding to the width of the free space as an inlay between each respective modular unit allocated ground slab.

The liquid-resistant band is to be secured in liquid-resistant fashion, for example wholly welded, to said first and second parts.

Over said band there is applied, within the formed gap or the free space, between the first edge extent of the first base slab and the second edge extent of the second base slab a reinforcement means absorbing developed tractive forces.

Said reinforcement means is then to be formed from two or more reinforcement iron rods, extending through lugs in the mutually facing edge extents of the base slabs and through holes formed in connection plates.

As concrete material, use is primarily intended to be made of a concrete material reinforced with fibres, for example viscous fresh concrete material reinforced with steel fibres.

Different forms and designs of modular elements, adapted for the process as well as a house body produced from these modular elements moreover fall within the scope of the present invention.

Advantages

Those advantages which may principally be deemed to be characteristic of the present invention and the special significative characterising features disclosed thereby are that there have hereby been created the preconditions for disclosing a process for a combining of modular elements produced as semi-manufactures and displaying different degrees of refinement to a house body, such as a cellar-related house body, where bottom portions allocated to the modular elements are united with one another via tractive force absorbing means and via casting are united to one another, so as to form a stable construction, ideally with a circumferential tight liquid-resistant layer.

That which may principally be deemed to be characteristic of the present invention is disclosed in the characterising clauses of appended claims 1 and 11.

BRIEF DESCRIPTION OF THE ACCOMPANYING DRAWINGS

One currently proposed embodiment, displaying the significative characterising features associated with the present invention, will now be described in greater detail hereinbelow for purposes of exemplification with reference to the accompanying Drawings, where:

Figure 5:
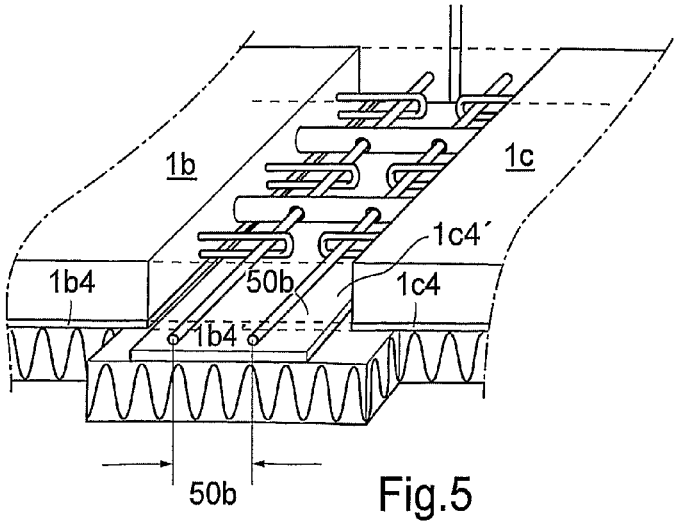
Figure 6:
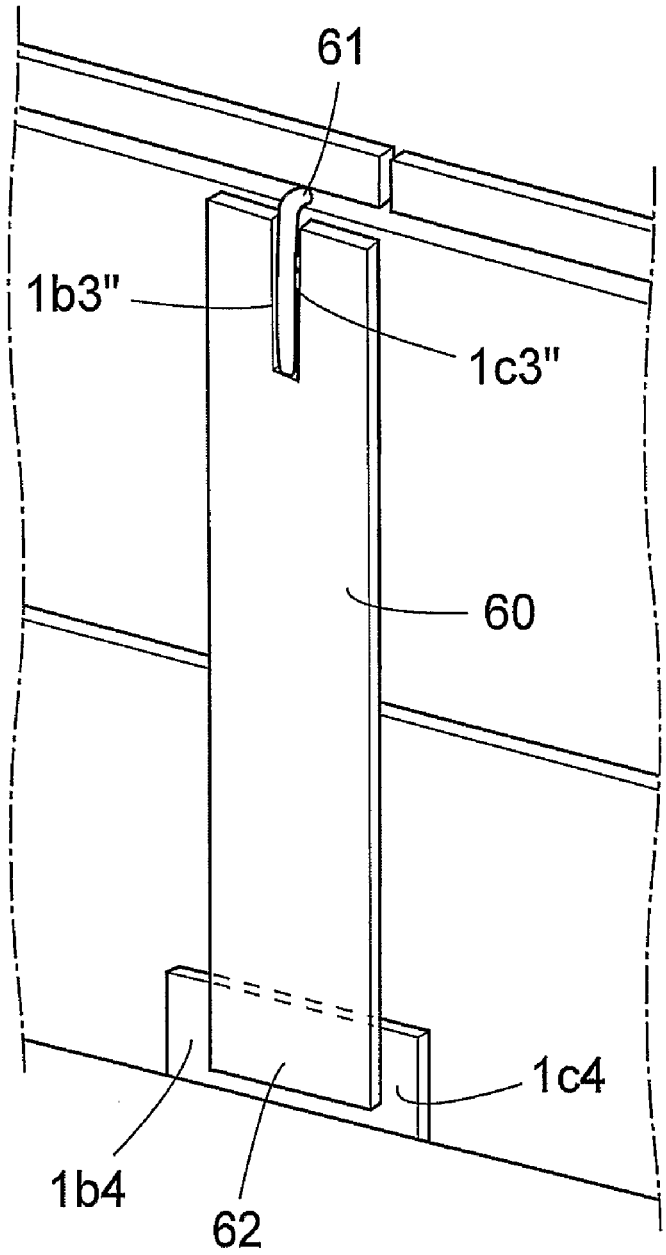

FIG. 5 is a perspective view of the principles of connecting a base slab for a second modular unit with a base slab for a third modular unit, under the utilisation of a narrower liquid-resistant strip or band, adapted to obtain a liquid-tight cooperation each with its resistant layer, for its modular unit of a second application; and FIG. 6 is a perspective view of a seal formed in accordance with the disclosures of the present invention between wall portions for the first modular unit and the second modular unit.

DESCRIPTION OF CURRENTLY PROPOSED EMBODIMENT

Figure 1:
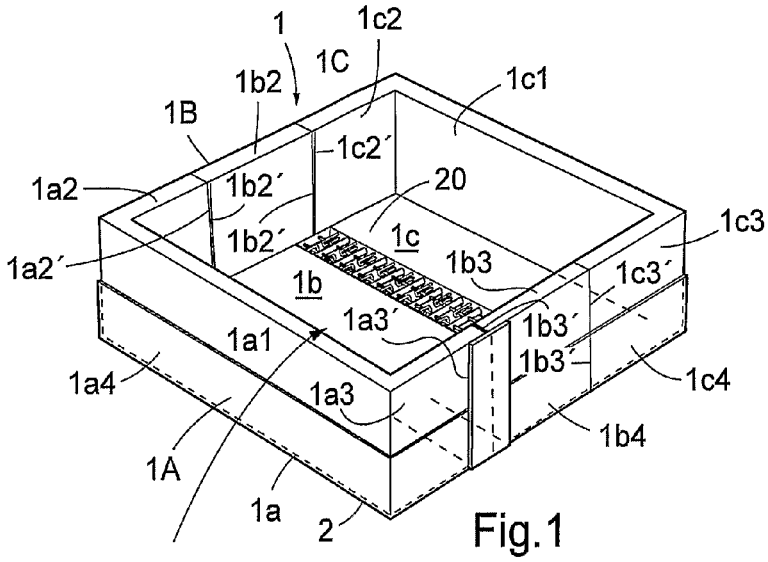
FIG. 1 is a perspective view of a house body, a cellar body, consisting of three mutually combinable prefabricated modular units, where a first modular unit is, in accordance with the present invention, united with a second prefabricated modular unit and where a third prefabricated modular unit is merely placed closely adjacent the second modular unit.

By way of introduction, FIG. 1 then constitutes one example of a house body 1, which is shown in perspective, here illustrated as a cellar body 1 consisting of three mutually combinable prefabricated modular units, where a first modular unit 1A is, according to the present invention, united with a second prefabricated modular unit 1B and where a third prefabricated modular unit 1C is placed closely adjacent the second modular unit 1B.

However, in this context it should be observed that expressions selected here should not be seen as restrictive exclusively to the terms utilised here and selected but it should be understood that every such selected term is to be interpreted so that in addition it encompasses all technical equivalents which function in the same or substantially the same manner in order thereby to be able to attain the same or substantially the same intention and/or technical effect.

With reference to the accompanying figures, there are thus illustrated schematically and in detail the basic preconditions for the present invention and where the significative properties associated with the present invention have been given concrete form as a result of the now proposed and hereinafter more closely described embodiment, the method or the process and where the figures illustrate individual specially constructed and prefabricated modular units, individual parts and details which are required for carrying the process into effect as well as finally a house body, particularly intended as a cellar module and produced in accordance with the significative method.

By way of introduction, FIG. 1 then constitutes one example of a house body 1, which is shown in perspective, here illustrated as a cellar body 1 consisting of three mutually combinable prefabricated modular units, where a first modular unit 1A is, according to the present invention, united with the second prefabricated modular unit 1B and where a third prefabricated modular unit 1C is merely placed closely adjacent the second modular unit 1B.

More specifically, it should be mentioned that these modular units display a base slab 1*a*, 1*b* and 1*c*, respectively, of concrete and where the first modular unit 1A displays wall portions secured to its base slab 1*a*, an elongate wall portion 1*a*1 and two laterally oriented short wall sections 1*a*2 and 1*a*3.

The short wall sections 1*a*2, 1*a*3 each display a vertical end surface 1*a*2' and 1*a*3' facing towards corresponding end surfaces 1*b*2', 1*b*3' for the second modular unit 1B.

The second modular unit 1B also displays parallel end surfaces 1*b*2' and 1*b*2" and 1*b*3' and 1*b*3", which face towards the third modular unit 1C and its vertical end surfaces 1*c*2' and 1*c*3'.

A liquid-resistant layer 1*a*4, 1*b*4 and 1*c*4, respectively, is intended to extend under each respective modular unit and extend upwards over the wall sections, for the first modular unit 1A designated 1*a*1, 1*a*2, 1*a*3 or only a distance, according to the illustrated embodiment.

Figure 2:
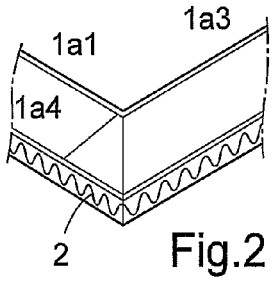
FIG. 2 is a perspective view of a corner portion of the first modular unit.

FIG. 2 shows in perspective view a corner portion of the first modular unit 1A, where the layer 1*a*4 has been folded overlapping and where a base slab 1*a* is supported by an insulation mat 2, a ground slab.

Figure 3:
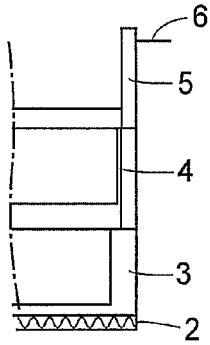
FIG. 3 is a side elevation of the principles for creating, with the aid of prefabricated modular units, a house body with different storeys, all placed under ground level and therefore allocated mutually different wall thicknesses.

FIG. 3 is a side elevation showing the principles for creating with the aid of prefabricated modular units 1A, 1B, 1C, a first house body 3, a second house body 4 and third house body 5, representing different storeys, where all house bodies illustrated here can be placed under a ground level 6, in which event all house bodies 3 to 5 each have its allocated outer liquid-resistant layer directly applied to its wall portion in order to fully cover this wall portion and preferably an outer insulating mat, a ground panel (not shown).

Figure 4:
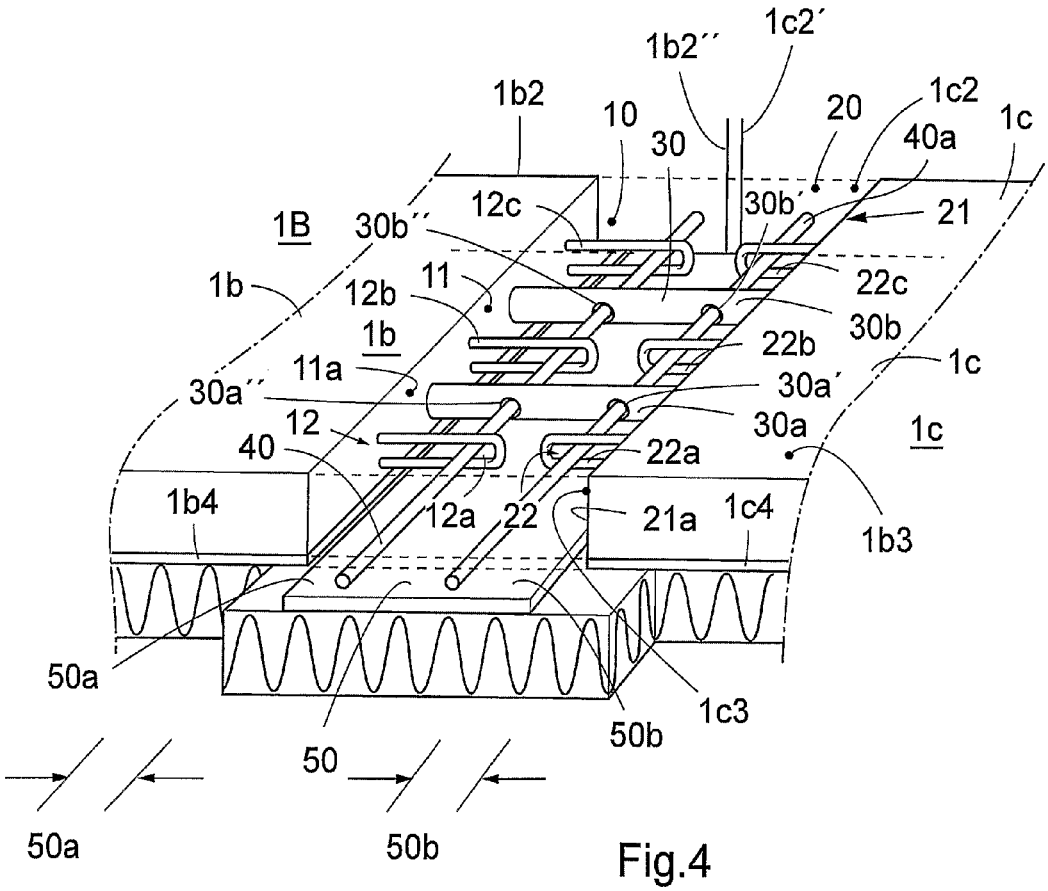
FIG. 4 is a perspective view of the principles of connecting a base slab for a (second) modular unit with a base slab for a (third) modular unit, under the utilisation of a wide liquid-resistant strip or band, adapted to obtain a liquid-tight cooperation each with its resistant layer each for a modular unit of a first practical application.

FIG. 4 is now intended to illustrate that the base slab 1*b* of the second modular unit 1B is formed with a recess 10, and this recess 10 extends between opposing wall sections 1*b*2, 1*b*4. via an edge extent 11. The end surface 11*a* is provided with a number of U-shaped stirrups 12, in the form of three stirrups 12*a*, 12*b*, and 12*c*.

FIG. 4 also is intended to illustrate that the bottom plate 1*c* of the third modular unit 1C in a corresponding manner is to be formed with a recess 20, and this recess extends between opposing wall sections 1*c*2, 1*c*3. via an edge extent 21. The end surface 21*a* is provided with a number of U-shaped stirrups 22, in the form of three stirrups 22*a*, 22*b* and 22*c*.

FIG. 4 is more specially intended to utilise connection parts 30, where each one of these connection parts 30*a*, 30*b* are provided with two holes 30*a*", 30*a*", 30*b*", 30*b*" and through which holes 30*a*", 30*b*" and stirrups 12*a*, 12*b* and 12*c*, respectively there are placed, for example by shifting, a reinforcement iron rod or a reinforcement rod 40.

A second reinforcing rod (intimated by reference numeral 40*a*) is to be passed through a hole 30*a*', 30*b*' and the stirrups 22*a*, 22*b* and 22*c* in the same manner as for the reinforcing iron or reinforcing rod 40.

It is here specially shown that under the liquid-resistant layers 1*b*4 and 1*c*4 rests a liquid-resistant layer, in the form of a strip or a band 50.

It should here be specially noted that the liquid-resistant layers 1*b*4, 1*c*4 extend up to the edge extent 11 and 21, respectively and that the band 50 is selected wider than the width of the gap or the recess 10, 20.

In such instance, there will be formed two overlapping regions 50*a* and 50*b*, adapted for a liquid-resistant connection, for instance welding, gluing or similar material, with the layers 1*b*4, 1*c*4.

It should specially be noted, with reference to FIG. 5, that the liquid-resistant layers 1*b*4, 1*c*4 extend over the edge extent 11, 21 respectively and that the band 50 is selected wider than the width of the gap or the recess 10, 20 a distance or with a surface section 1*b*4' and 1*c*4'.

In this instance there will also be formed here two overlapping regions (50*a* not shown) 50*b*, adapted for a liquid-resistant connection, such as welding, gluing or similar material, with the subjacent layers 1*b*4', 1*c*4'.

When the base slabs 1*b* and 1*c* have been connected in the disclosed manner the spaces 10 and 20 are filled with concrete material, preferably steel fibre reinforced concrete material.

FIG. 6 illustrates that a liquid-resistant layer 60 has been applied in order to be able to cover that gap which is formed between the end surfaces 1*b*3" and 1*c*3". This gap can be sealed by an elastic or foldable hose 61.

The lower layer section 62 is to be liquid-resistantly united with the sections 1*b*4 and 1*c*4, respectively.

FIG. 6 also illustrates that the wall portions 1*b*2 and 1*c*2, respectively can be double-walled with an inner empty space and which wall portions can serve as mould halves for a concrete casting of the empty space.

Thus described, the invention now makes for the presentation of a method or a process for initially combining and thereafter uniting two or more modular units to one another, in order thus combined to be able to form a house body, such as a cellar-adapted house body 1.

Each one of these modular units 1A, 1B and 1C, respectively, consists of a base slab 1*a*, 1*b*, 1*c*, a plurality, such as two or more, wall portions coordinated with the base slab and where necessary a liquid (water) resistant layer, where said liquid-resistant layer advantageously wholly or partly is to be able to cover the base slab and in any event lower wall sections allocated to the wall portion proximal the base slab in order principally to prevent damp permeation.

The method is then based on the following sequence of action:

A first modular unit, with in any event one open wall portion, is placed on a substrate, prepared within a building site, that a second modular unit, with in any event one open wall portion is placed on said substrate, prepared within the building site, so that the open wall portion allocated to the first modular unit will connect to the open wall portion allocated to the second modular unit, the base slab of the one modular unit and the base slab of the second module is to form a free space, defined by the mutually facing edge extents of the base slabs, whereafter the base slab of the one modular unit is connected, with the aid of one or more tractive force absorbing means, with the base slab of the second modular unit across said free space and that the free space is finally filled with concrete or similar viscous concrete material with a fibre reinforcement.

Towards and/or over said free space extends a first part of the one modular unit, along its allocated edge extent, facing towards the second modular unit, allocated liquid-resistant layer, towards and/or over said free space extends a second part of the second modular unit, along its allocated edge extent, facing towards the first modular unit, allocated liquid-resistant layer, is placed a band of a liquid-resistant material.

Said band is dimensioned in order wholly or partly to be able to cover said first part and said second part and that band sections are secured or sealed in liquid-resistant fashion to said first part and to said second part.

The liquid-resistant layer, related to the first and the second modular unit, is given such surface-adapted dimensions that each one of the layers extends under the base slab and upwards a selected distance along one or two wall sections and that said strip or band is given a corresponding length.

Insulating ground slabs or plates are secured to the outer surface extent of said liquid-resistant layer.

Under said strip or band is applied a narrow ground slab or plate corresponding to the width of the free space, as an inlay between each respective modular unit-allocated ground slab or plate.

The liquid-resistant band is wholly welded to said first and second parts.

Over said band is applied a tractive absorbing reinforcement, within the formed gap between the first edge extent of the first base slab and the second edge extent of the second base slab.

Said reinforcement is here formed by two or more reinforcement iron rods or reinforcement rods, extending through lugs in the mutually facing edge extents of the base slabs and formed holes in specially formed connection plates.

As concrete material use can be made of a concrete material reinforced with steel fibres, a concrete material reinforced with carbon fibres and/or a concrete material reinforced with glass fibres.

The invention also encompasses one or more modular units, one or more house bodies, one or more house bodies serving as cellars.

The invention is naturally not restricted to the above embodiment disclosed by way of example, but can undergo modifications within the scope of the inventive concept illustrated in the appended Claims.

It should be specially observed that every illustrated unit and/or circuit can be combined with every other illustrated unit and/or circuit within the scope in order to be able to attain the desired technical function.

The invention claimed is:

1. A process of combining and then uniting a plurality of concrete modular units to one another, to thereby form a house body, each of the modular units being comprised of a base slab, a plurality of wall portions secured to the base slab and a liquid-resistant layer, the process comprising the steps of:

placing a first of the plurality of concrete modular units with a first open wall portion on a substrate prepared within a building site, placing a second of the plurality of concrete modular units with a second open wall portion on the substrate, so that the first open wall portion corresponding to the first modular unit connects to the second open wall portion corresponding to the second modular unit, wholly or partly covering the base slabs and lower wall sections of the plurality of wall portions, which are proximal to the base slabs, of the first and second modular units with the liquid-resistant layers of the first and second modular units, to thereby prevent dampness from permeating the first and second modular units, orienting the base slab of the first modular unit and the base slab of the second modular unit to form a free space, defined by mutually facing edges of the base slabs of the first and second modular units, connecting the base slab of the first modular unit, with the aid of a tractive force absorbing reinforcement, to the base slab of the second modular unit over the free space, and filling the free space with a viscous concrete material.

2. The process as claimed in claim 1, further comprising the steps of:

bringing towards and/or over the free space a first part of the first modular unit, along its corresponding edge facing towards the second modular unit, and provided with its corresponding liquid-resistant layer bringing towards and/or over the free space a second part of the second modular unit, along its corresponding edge facing towards the first modular unit, and provided with its corresponding liquid-resistant layer, and a band of a liquid-resistant material.

3. The process as claimed in claim 2, wherein the band is dimensioned to be wholly or partly covered by the first part and the second part, and wherein sections of the band are secured or sealed in a liquid-resistant fashion to the first part and to the second part.

4. The process as claimed in claim 2, wherein the liquid-resistant layers of the first and the second modular units have surface dimensions, such that each one of the layers extends under the base slab and upwards a selected distance along one or two wall sections of its corresponding modular unit, and wherein the band has a corresponding length.

5. The process as claimed in claim 1, wherein insulating ground slabs or plates are secured to the outer surface extension of the liquid-resistant layer.

6. The process as claimed in claim 2, a narrow ground plate or slab corresponding to the width of the free space is applied under the band, as an inlay between ground plates or slabs allocated to each respective modular unit.

7. The process as claimed in claim 2, wherein the liquid-resistant band is wholly welded to the first and second parts.

8. The process as claimed in claim 1, wherein the tractive force absorbing reinforcement is applied over the band, within the formed free space between the first edge of the first base slab and the second edge of the second base slab.

9. The process as claimed in claim 8, wherein the reinforcement is formed from two or more reinforcement iron rods, extending through lugs in the mutually facing edges of the base slabs and formed holes in specially formed connection plates.

10. The process as claimed in claim 1, wherein the concrete material is a concrete material reinforced with fibres.

11. A house body, comprising:

a plurality of modular units, each modular unit including a base slab, a plurality of wall portions secured to the base slab and a liquid-resistant layer, a first of the plurality of modular units, with a first open wall portion, placed on a substrate prepared within a building site, a second of the plurality of modular units, with a second open wall portion, placed on the substrate, so that the first open wall portion, corresponding to the first modular unit, connects to the second open wall portion, corresponding to the second modular unit, first and second liquid-resistant layers wholly or partly covering the base slab and lower wall sections of the wall portions, which are proximal to the base slab, of the first and second modular units, respectively, to thereby prevent dampness from permeating the base slabs of the first and second modular units, a free space formed by the base slab of the first modular unit and the base slab of the second modular unit, and defined by mutually facing edges of the base slabs, one or more tractive force absorbing reinforcements connecting the base slab of the first modular unit to the base slab of the second modular unit over the free space, and a concrete material filling the free space.

12. The house body as claimed in claim 11, wherein a first part of the first liquid-resistant layer, corresponding to the first modular unit along its allocated edge extension facing towards the second modular unit is disposed to extend towards and/or over the free space, a second part of the second liquid-resistant layer, corresponding to the second modular unit along its allocated edge extension facing towards the first modular unit, is disposed to extend towards and/or over the free space, and a band of a liquid-resistant material is placed over the free space.

13. The house body as claimed in claim 12, wherein the band is dimensioned to wholly or partly cover the first part and the second part, and wherein sections of the band are secured or sealed, in a liquid-resistant fashion, to the first part and the second part.

14. The house body as claimed in claim 12, wherein the liquid-resistant layers, corresponding to the first and the second modular units, have surface dimensions, such that each one of the layers extends under the base slab and upwards a selected distance along one or two wall sections of its corresponding modular unit, and wherein the band has a corresponding length.

15. The house body as claimed in claim 11, wherein insulating ground plates or slabs are secured to outer surface extensions of the liquid-resistant layers.

16. The house body as claimed in claim 11, wherein a narrow ground plate or slab corresponding to the width of the free space is applied under the band, as an inlay between ground plates or slabs allocated to each respective modular unit.

17. The house body as claimed in claim 11, wherein the liquid-resistant band is wholly welded to the first and second parts.

18. The house body as claimed in claim 12, wherein a the tractive force absorbing reinforcement is applied over the band, within the formed free space between the first edge and the first base slab and the second edges of the second base slab.

19. The house body as claimed in claim 18, wherein the tractive force absorbing reinforcement is formed from two or more reinforcing iron rods, extending through lugs in the mutually facing edges of the base slabs and formed holes in specially formed connection plates.

20. The house body as claimed in claim 18, wherein the concrete material is a concrete material reinforced with fibres.

* * * * *